US005946182A

United States Patent [19]

Hertzog et al.

[11] Patent Number: 5,946,182

[45] Date of Patent: Aug. 31, 1999

[54] POWER SUPPLY CIRCUIT FOR AN ELECTROMAGNETIC COIL HAVING LOW DC AND HIGH AC VOLTAGE SUPPLY

[75] Inventors: Nicolas Hertzog, Rueil-Malmaison; Thierry Ourth, Paris; Michel Ledroit, Yerres, all of France

[73] Assignee: Schneider Electric SA, Boulogne Billancourt, France

[21] Appl. No.: 08/972,326

[22] Filed: Nov. 18, 1997

[30] Foreign Application Priority Data

Nov. 18, 1996 [FR] France ..... 96 14122

[51] Int. Cl.[6] ..... H01H 47/26

[52] U.S. Cl. ..... 361/205; 361/189

[58] Field of Search ..... 361/189, 195, 361/196, 197, 205, 206, 209, 154; 307/2

[56] References Cited

U.S. PATENT DOCUMENTS

| | | | |
|---|---|---|---|
| 4,112,477 | 9/1978 | Sherwin | 361/155 |
| 4,185,315 | 1/1980 | Miller | 361/205 |
| 4,391,236 | 7/1983 | Anderson . | |
| 4,516,185 | 5/1985 | Culligan et al. | 361/154 |
| 4,567,541 | 1/1986 | Terai | 361/235 |
| 5,734,543 | 3/1998 | Turner | 361/154 |

FOREIGN PATENT DOCUMENTS 0 091 648 A1 10/1983 European Pat. Off. .

OTHER PUBLICATIONS

Patent Abstracts of Japan, vol. 8, No. 95, (E–242), May 2, 1984 and JP 59 014615 A, Jan. 25, 1984.

Patent Abstracts of Japan, vol. 8, No. 139, (E–253), Jun. 28, 1984 and JP 59 048903 A, Mar. 21, 1984.

*Primary Examiner*—Jeffrey Gaffin
*Assistant Examiner*—Kim Huynh
*Attorney, Agent, or Firm*—Oblon, Spivak, McClelland, Maier & Neustadt, P.C.

[57] ABSTRACT

Power supply circuit for a single-winding electromagnet coil (11) comprising a low voltage DC power supply (20) and a high voltage AC power supply (30) both connected to the terminals of the winding (11), together with a switching apparatus (40) connected in series with the high voltage supply (30) and capable of supplying or cutting the high voltage power supply to the winding (11), characterized by the fact that the switching device (40) comprises a thyristor (42) connected between the high voltage source (30) and the winding (11) and a control circuit (43) for the thyristor (42) connected to the gate (G) of the thyristor used to cause the thyristor to conduct when the high voltage source (30) delivers the positive phase of a voltage wave.

5 Claims, 1 Drawing Sheet

POWER SUPPLY CIRCUIT FOR AN ELECTROMAGNETIC COIL HAVING LOW DC AND HIGH AC VOLTAGE SUPPLY

The present invention relates to a power supply circuit for a single-winding electromagnet coil comprising a low voltage DC power supply and a high voltage AC power supply both connected to the terminals of the winding, together with a switching device connected in series with the high voltage supply and capable of supplying or cutting the high voltage supply to the winding.

DISCUSSION OF BACKGROUND

It is known in the art that an electromagnet can be powered by energizing the associated coil using a high level of current known as the trigger current to cause the movable magnetic circuit of the electromagnet to rise; the movable magnetic circuit can then be maintained using a low current known as the holding current. This minimizes consumption and heat dissipation.

In order for successive high and low currents to be used a coil may consist of two windings: a principal coil dimensioned to carry most of the trigger current and an auxiliary winding sufficiently dimensioned to supply the power required to retain the movable armature.

The large size of this type of double-winding coil, however, is a considerable drawback.

To overcome these problems coils exist in which a single winding is connected to single high-voltage source. Since the winding is dimensioned to carry the trigger current the power supply circuit is fitted with a chopper device that serves to lower the current energizing the coil to its holding level. However this type of device is costly and must be adapted to each voltage used, whether 100 V or 400 V.

It is therefore a purpose of the present invention to energize a single-winding electromagnet coil using a low-cost power supply circuit that can be used equally well at voltages ranging from 100 to 500 Volts.

SUMMARY OF THE INVENTION

In the present invention the power supply circuit is characterized in that the switching device comprises a thyristor connected between the high voltage power supply and the winding, together with a thyristor control circuit connected to the terminals of the thyristor and connected to the gate. The control circuit causes the thyristor to conduct when the high voltage power supply delivers the positive phase of a voltage wave.

The power supply circuit of the invention therefore requires no consumption reducing device since the high voltage power supply is halted and the winding remains energized by the low voltage supply. This switchover operates automatically when the AC current reaches zero as it passes through the thyristor.

BRIEF DESCRIPTION OF THE DRAWINGS

The advantages of the present invention will be better understood from the following description which refers to the attached drawing where.

DETAILED DESCRIPTION OF THE PREFERRED EMBODIMENT

Figure 1:
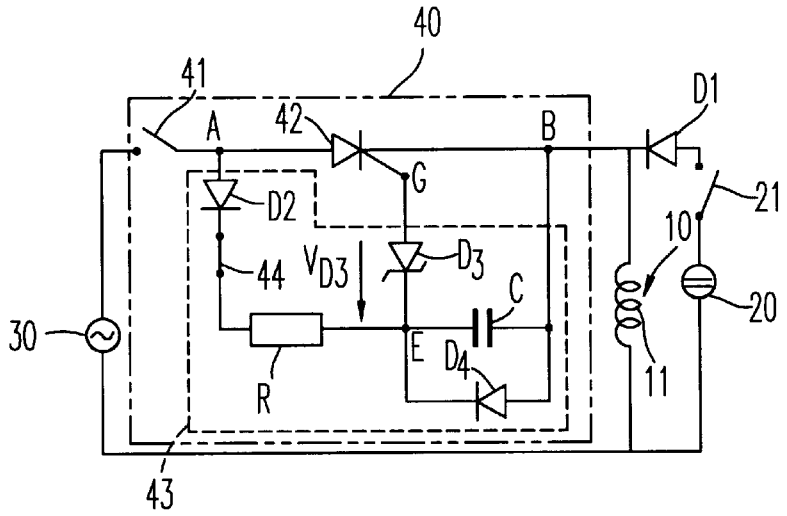
FIG. 1 is a diagram of the power supply circuit of an electromagnet coil according to the invention.

The diagram in FIG. 1 shows the power supply circuit of the coil 10 of an electromagnet. This coil has a single winding 11 and is part of an electromagnet designed for use with a contactor-type switch.

The electromagnet (not shown) comprises the coil 10, a fixed magnetic circuit and a moving magnetic circuit designed to be attracted by the fixed magnetic circuit when the coil is energized.

Movement of the moving magnetic circuit is initiated when a strong trigger current consisting of a high voltage AC current from power supply 30 is supplied to the terminals of winding 11. This current passes briefly through the winding 11 of the coil. The moving magnetic current is maintained in its new position by the continuous energizing of the coil by a holding current that is weaker than the trigger current and provided by a low voltage DC supply 20 that is also connected to the terminals of winding 11, between a high voltage line L1 and a low voltage line L2.

The high voltage AC supply 30 may be a mains power supply and the low voltage DC supply 20 may be a supply of around 12 Volts designed for powering electronic circuits, provided, for example, by a transformer in which the primary constitutes part of the current path of a derived electric circuit through which the DC current passes.

A diode D1 is preferably connected in series with the low voltage supply 20 to prevent the high voltage charge returning to source 20 when the coil is energized by the high voltage supply 30.

A switching device 40 is connected in series with the high voltage supply 30. This device is capable of either carrying or obstructing the high voltage supply to winding 11.

Between the high voltage power supply 30 and winding 11 device 40 comprises an on/off switch 41 and a thyristor 42 connected in series. Thyristor 42 can be triggered by a control circuit 43 connected in parallel with the thyristor to two connection points of anode A and cathode B and also connected to the gate G of the thyristor.

In the embodiment shown in FIG. 1 control circuit 43 comprises the following components connected in series: a diode D2 whose anode is connected to connecting point A, a switch 44 that is normally closed and a timer circuit RC. The timer circuit comprises a variable resistor R which is connected in series to a switch 44 and a capacitor C connected to connecting point B.

Control circuit 43 consists of a Zener or controlled avalanche type diode D3 disposed between the gate G of thyristor 42 and a connection point E between resistor R and capacitor C, together with a recovery diode D4 whose cathode and anode are connected to connection points E and B respectively.

Clearly other control circuits 43 may be devised to perform the same function of triggering thyristor 42.

Figure 2:
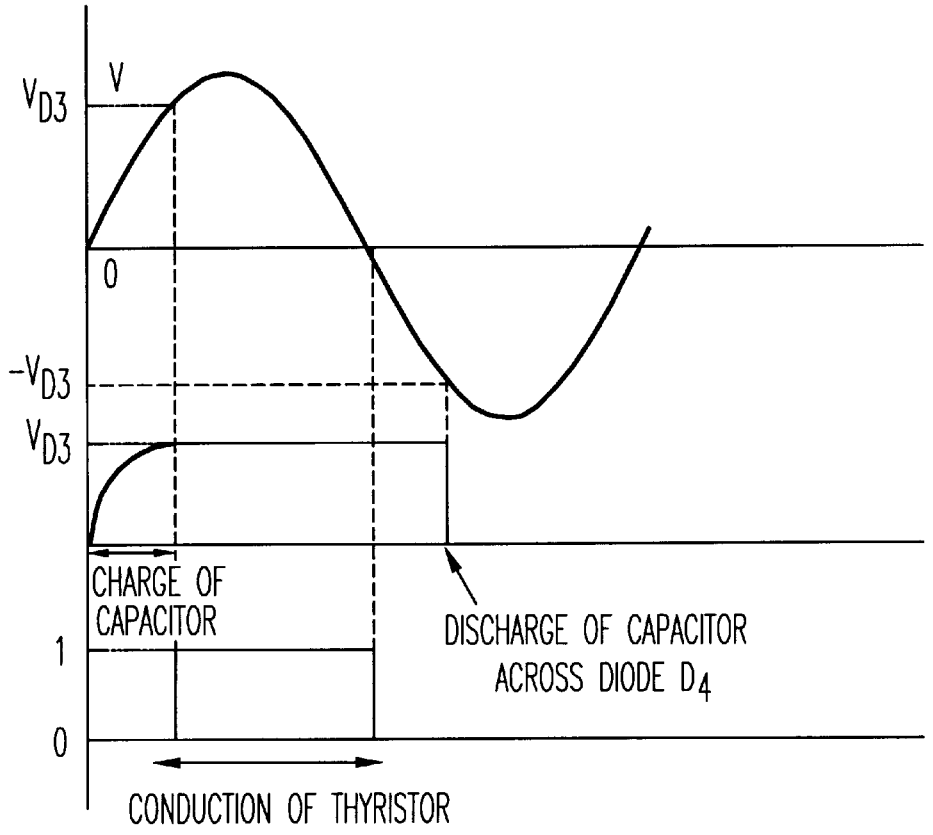
FIG. 2 is a diagram showing how the power is conducted through the power supply circuit thyristor.

The operation of the circuit in the embodiment described above will now be described with reference to FIG. 2.

The low voltage DC supply provided by source 20 is applied to winding 11 but is insufficient to provide the ampere-turns required to trigger movement of the movable magnetic circuit.

To close the magnetic circuit, switch 41 is closed, providing a high voltage V from source 30 to winding 11.

Closing switch 41 causes current to flow through timer circuit RC which charges capacitor C.

When the voltage at the terminals of capacitor C reaches a voltage $V_{D3}$ that is the same as the conducting voltage of diode D3 the gate G of the thyristor receives a command pulse via diode D3 and thyristor 42 becomes conducting.

Voltage $V_{D3}$ is characteristic of the triggering delay of thyristor 42 that is the time elapsed between closing of switch 41 and the thyristor becoming conducting. Voltage $V_{D3}$ is dependent on the charge time of capacitor C which is itself a function of the value of variable resistor R. The triggering delay of the thyristor is therefore adjustable as a function of the value of the resistor. Resistor R is adjusted so that the gate G of the thyristor is triggered during the rise of a positive alternance of the voltage wave that passes through the thyristor.

Suitable detection means are provided to ensure that the triggering of thyristor 42 cause opening of switch 44 to prevent a second positive alternance of voltage V passing through circuit 43.

Thyristor 42 conducts and provides a power supply to winding 11 that is sufficiently energized to cause movement of the movable magnetic circuit.

When the voltage wave passing through the thyristor reaches zero the thyristor switches off and the power supply to the high voltage coil is cut. It is then possible to command opening of switch 41.

Capacitor C may discharge by means of recovery diode D4 when voltage V reaches an absolute value greater than $V_{D3}$.

The coil only remains energized by the current provided by the low voltage source 20 which enables the moving magnetic circuit to be maintained in the raised position.

To lower the moving magnetic circuit the power supplied by source 20 is cut off by means of a mechanical or electrical switching device 21 connected in series between the source 20 and diode D1 (FIG. 1). In a variant of the embodiment switch 21 may be connected in parallel with winding 11 between the cathode of diode D1 and low voltage line L2, or in series with the coil (not shown).

We claim:

1. Power supply circuit for a single-winding electromagnet coil comprising a low voltage DC power supply and a high voltage AC power supply both connected to the terminals of the winding, together with a switching apparatus connected in series with the high AC voltage supply and capable of supplying or cutting the high voltage power supply to the winding and a switching device for cutting the low DC voltage power supply to the winding, wherein the switching device comprises a thyristor connected between the high AC voltage power supply and the winding, together with a circuit that controls the thyristor connected to the gate (G) of the thyristor;

the control circuit causes the thyristor to conduct when the high AC voltage power supply delivers the positive phase of a voltage wave.

2. Power supply circuit for coil of claim 1, wherein the control circuit comprises a timer circuit (RC) disposed on the terminals of thyristor and connected in series to a resistor (R) and a capacitor (C) together with a diode (D3) whose anode and cathode are connected respectively to gate (G) of the thyristor and a connection point E located between the resistor (R) and the capacitor (C).

3. Power supply circuit for coil of claim 1 or 2 wherein the control circuit comprises a switch for cutting the power supply of said control circuit once thyristor has been triggered.

4. Power supply circuit for coil of claim 3 wherein the control circuit comprises a recovery diode (D4) connected in parallel with capacitor (C) that ensures discharge of the capacitor after triggering of the thyristor and opening of switch (44).

5. Power supply circuit for coil of claim 1 wherein an on/off switch is connected between the high voltage source and the thyristor.

* * * * *